United States Patent [19]

Ronk

[11] 4,297,551

[45] Oct. 27, 1981

[54] ELECTRICAL TRANSFER SWITCH

[75] Inventor: Leroy B. Ronk, Nokomis, Ill.

[73] Assignee: Ronk Electrical Industries, Inc., Nokomis, Ill.

[21] Appl. No.: 135,266

[22] Filed: Mar. 31, 1980

[51] Int. Cl.[3] ..... H01H 5/08

[52] U.S. Cl. ..... 200/67 B

[58] Field of Search ..... 200/67 B, 67 R, 67 A, 200/67 E, 241, 250, 245

[56] References Cited

U.S. PATENT DOCUMENTS

| | | | |
|---|---|---|---|
| 1,738,406 | 12/1929 | Townsend | 200/67 B |
| 1,852,899 | 4/1932 | Ramsay | 200/67 B |
| 4,165,453 | 8/1979 | Heinemann | 200/67 B |

FOREIGN PATENT DOCUMENTS

| | | | |
|---|---|---|---|
| 1052496 | 3/1959 | Fed. Rep. of Germany | 200/67 B |

OTHER PUBLICATIONS

Ronk Electrical Industries Brocure No. 6771 Meter-Rite Switches, received Jan. 24 1979.

*Primary Examiner*—John W. Shepperd
*Attorney, Agent, or Firm*—Senniger, Powers, Leavitt and Roedel

[57] ABSTRACT

A transfer switch comprising a support, first and second fixed contacts mounted on the support and adapted to be connected to first and second sources of power, respectively, a rocker pivotable between first and second positions, a contactor carried by the rocker. The contactor is movable with respect to the first and second contacts and is engageable with the first fixed contact when the rocker is in its first position and with the second fixed contact when the rocker is in its second position. An actuator is provided for moving the rocker between its first and second positions, whereby the movable contactor is adapted to be connected to a first source of power when the rocker is in its first position and to a second source of power when the rocker is in its second position. The actuator comprises a shaft rotatably mounted on the support and an overcentering spring, the shaft having a handle and a crank and the spring being secured at one end to the crank and at the other end to the rocker. The rocker is pivotally mounted on the shaft and the shaft is rotatable on the support between first and second angular positions. The spring applies a force to the rocker causing the rocker to snap from one position to the other when the shaft is pivoted from one angular position to the other.

11 Claims, 11 Drawing Figures

ELECTRICAL TRANSFER SWITCH

BACKGROUND OF THE INVENTION

This invention relates to electrical switches, and more particularly to transfer switches for transferring a load from one power source to another.

This invention involves an improvement upon the prior art transfer switches of the type generally comprising first and second fixed contacts, a pivotally mounted contactor movable between a first position in which the contactor engages the first contact and a second position in which the contactor engages the second contact, and an actuator for moving the contactor between its positions. Each of the fixed contacts is connected to one of two power sources (e.g., line power and an auxiliary power source such as a generator), and the contactor is connected to a load. Upon movement of the movable contact from one position to the other, the load is transferred from one power source to the other.

SUMMARY OF THE INVENTION

Among the several objects of this invention may be noted the provision of a transfer switch of the type described having an actuator mechanism of simplified construction; and the provision of such a transfer switch which is compact and economical to manufacture.

In general, a transfer switch of this invention comprises a support, first and second fixed contacts mounted on the support, a rocker pivotable between first and second positions, and a contactor carried by the rocker, the contactor being movable with respect to the first and second contacts. The first fixed contact is connected to a terminal adapted to be connected to line power, and the second fixed contact is connected to a terminal adapted to be connected to a generator. The movable contactor is connected by a flexible conductor to a terminal mounted on the support, and is engageable with the first fixed contact when the rocker is in its first position and with the second fixed contact when the rocker is in its second position, whereby said terminal on the support is adapted to be connected to line power when the rocker is in its first position and to the generator when the rocker is in its second position. An actuator is provided for moving the rocker between its first and second positions, the actuator comprising a shaft rotatably mounted on the support and an overcentering spring, the shaft having a handle and a crank, the spring being secured at one end to the crank and at the other end to the rocker. The rocker is pivotally mounted on the shaft, and the shaft is rotatable on the support between first and second angular positions. The spring biases the rocker to its first position when the shaft is in its first angular position, biases the rocker to its second position when the shaft is in its second angular position, and applies a force to the rocker causing the rocker to snap from one of its positions to the other when the shaft is pivoted from one of its angular positions to the other.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
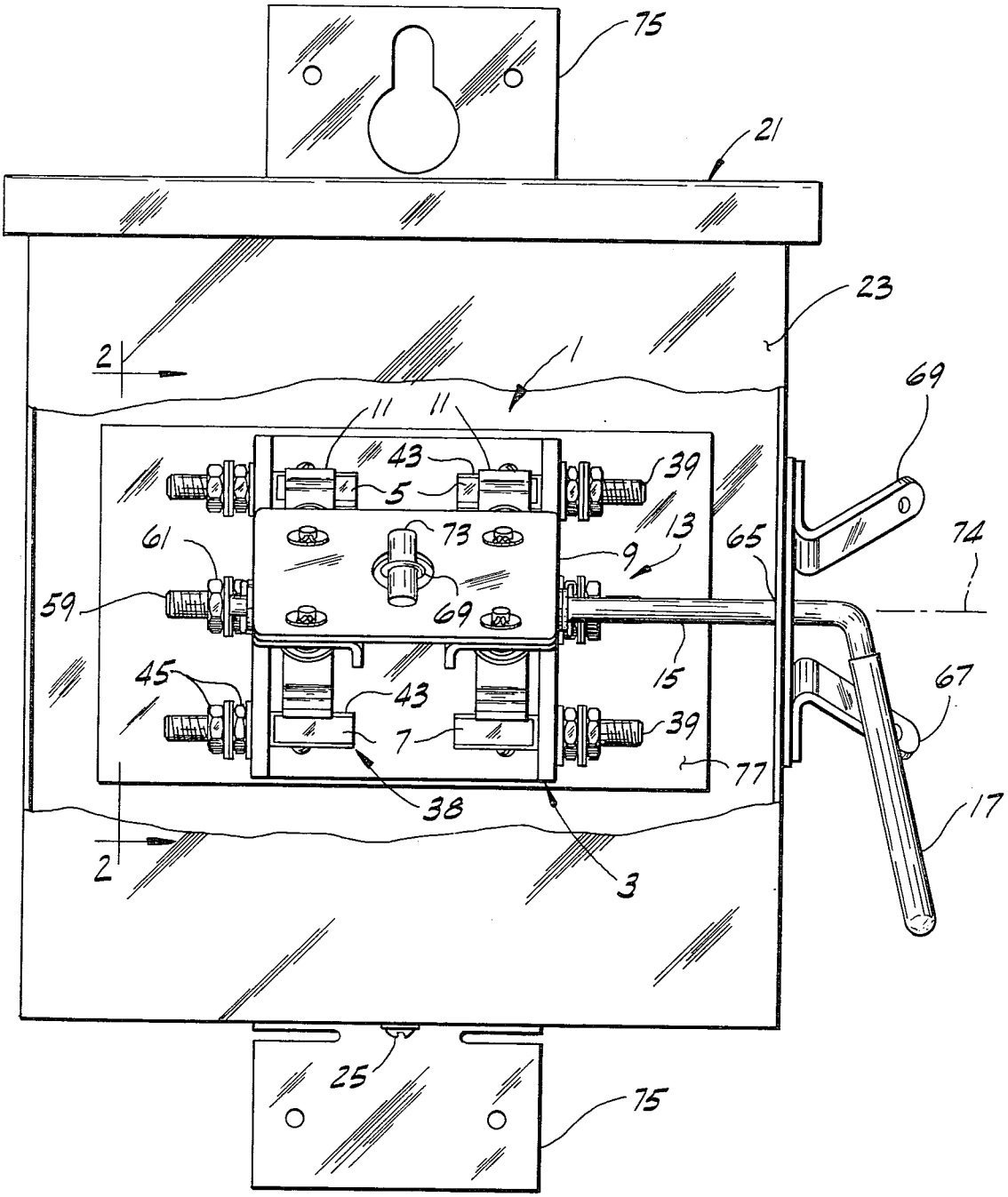
FIG. 1 is a front elevation of a transfer switch of this invention mounted in a housing, a portion of the housing being cut away.
Figure 3:
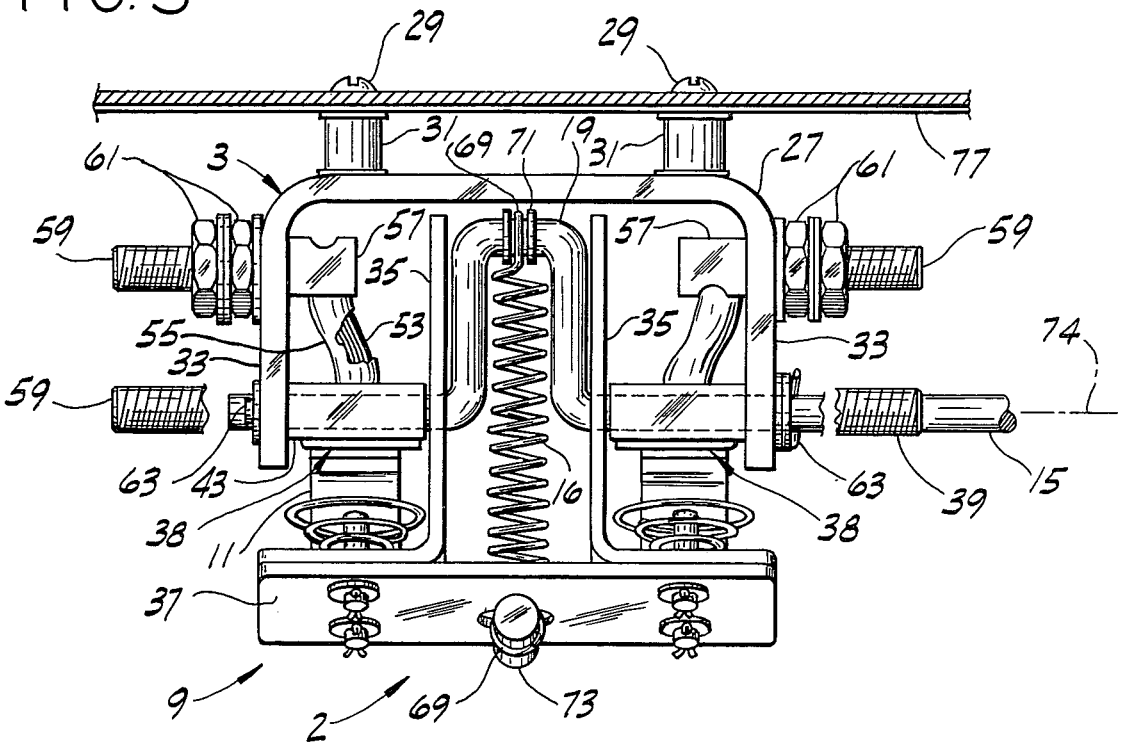
FIG. 3 is an top plan of the transfer switch on line 3—3 of FIG. 2.

Referring to the FIGS. 1–7, there is generally indicated at 1 a transfer switch of this invention comprising a support 3, a pair of first fixed contacts 5 mounted on the support, a pair of second fixed contacts 7 mounted on the support, a rocker 9 pivotable between first and second positions, a pair of contactors 11 carried by the rocker, the contactors being movable with respect to the first and second contacts and being engageable with the first fixed contacts when the rocker is in its first position and with the second fixed contacts when the rocker is in its second position, and an actuator 13 for moving the rocker between its first and second positions. Actuator 13 comprises a shaft 15 rotatably mounted on support 3 and an overcentering spring 16 (see FIG. 2), the shaft having a handle 17 and a crank 19 (see FIGS. 2 and 3), the spring being secured at one end to the crank and at the other end to the rocker. As shown in FIG. 1, the switch is enclosed in a housing 21 having a front cover panel 23 releasably secured to the sides thereof by a screw 25.

In particular, support 3 comprises a channel 27 (see FIGS. 2 and 3) of insulating material such as fiberglass reinforced plastic, the central portion of the channel being secured to the rear of housing 21 in spaced relation thereto by fasteners 29 and spacers 31, the sides 33 of the channel extending toward the front of the housing. The shaft 15 extends across channel 27 through axially aligned holes in sides 33 thereof, the shaft being rotatable within the holes. The rocker 9 is pivotally mounted on the shaft and has a pair of sides 35 extending toward the rear of the housing between sides 33 of the support, and a crosshead 37 at the end of the sides.

Fixed contact means 38 is provided at each of the outer corners of the channel 27, each contact means comprising a terminal such as a threaded binding post 39 at one end thereof extending outwardly from a side 33 of the channel through a hole therein, a contact base bar 43 at its other end extending inwardly from the side of the channel, and one of said first and second fixed contacts 5, 7 mounted on the contact base bar. The terminal and contact base bar are integral, and are of a suitable material such as cadmium plated copper. The contacts 5, 7 are of a suitable material such as a 9:1 silver and cadmium oxide mixture, the contacts being silver soldered to the respective contact base bar 43. Two nuts 45 are threaded onto each binding post 39, one nut for securing the contact means to the channel, the other for releasably securing a conductor of a power source (not shown) to the binding post. The switch is thus adapted to be connected to two power sources (e.g., line power and an auxiliary power source such as a generator), the respective terminals for the first fixed contacts being connected to one of the power sources and the respective terminals for the second fixed contacts being connected to the other power source.

The movable contactors 11 are elongate bars of suitable material such as cadmium plated copper having a contacting area 47 at each end thereof. Each movable contactor is yieldably mounted to the crosshead 37 of the rocker 9 by a pair of headed pins 49. Headed pins 49 have shanks extending through holes in the movable contactor and the crosshead, and a pair of springs 51 on the pins biasing the movable contactor away from the crosshead. Cotter pins 53 at the unheaded end of the pins retain the pins in the holes in the crosshead. The yieldable mounting of the movable contactors 11 on the rocker 9 enables the contacting areas 47 of the contactors to wipe across the contacts upon engagement and disengagement of the movable contactors with the fixed contacts to maintain a clean contacting surface for low contact resistance current flow. Each movable contactor is electrically connected by a flexible conductor 53 (see FIG. 3) covered by an insulating sleeve 55 to a terminal 57 mounted on channel 27, the terminal comprising a binding post 59 extending outwardly from a side 33 of the channel through a hole therein. Two nuts 61 are threaded on each binding post, one nut securing the binding post to the channel, the other for releasably securing one of two conductors for supplying an electrical load (not shown) to the binding post. When the switch is connected to the alternate power sources and the load, the "hot" conductors of the power sources and the corresponding conductor of the load are connected to the binding posts at one side of the channel, and the "common" conductors of the power sources and the corresponding conductor of the load are connected to the binding posts at the other side of the channel.

The shaft of the actuator for moving the rocker is rotatable between first and second angular positions and has means engageable with the sides 33 of the channel 27 such as cotter pins 63 for preventing axial movement of the shaft with respect to the channel. The shaft is bent to form the sides and crossbar of the crank 19, the sides of the crank extending between the sides 35 of the rocker. Each side of the rocker is engageable with those portions of the shaft at the bends from which the sides of the crank extend, thereby limiting axial movement of the rocker along the shaft. The shaft extends outwardly from a side of the switch 1 through a hole 65 in the side wall of housing 21 to a radially extending projection constituting the handle 17. The handle is engageable with first and second stops (67 and 69, respectively) secured to the side wall of the housing, the handle engaging the first stop 67 when the shaft is in its first angular position and the second stop when the shaft is in its second angular position. The handle 17 and crank 19 extend radially from the shaft in opposite directions.

Figure 2:
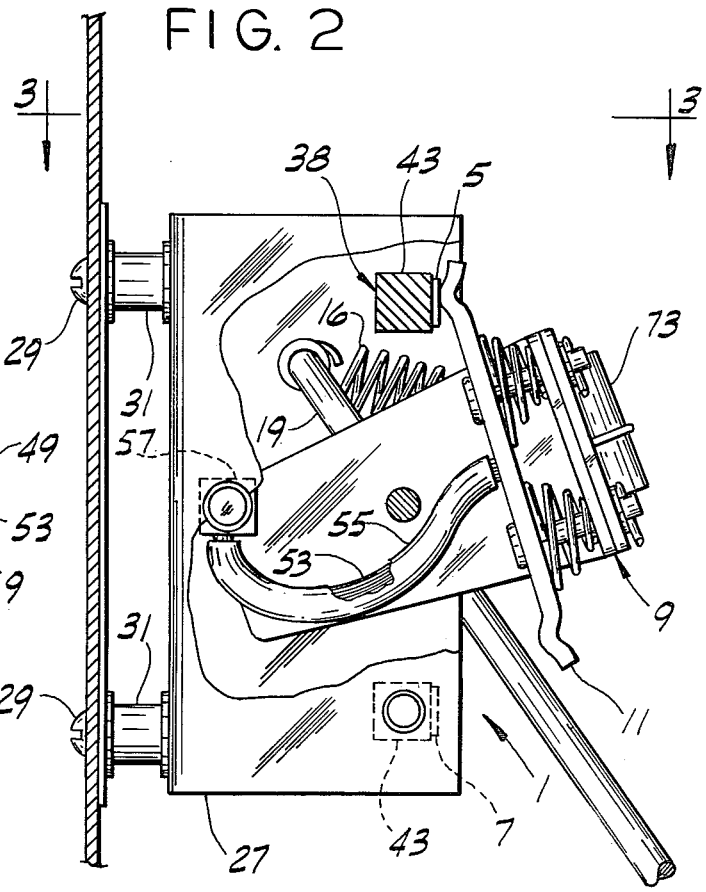
FIG. 2 is an enlarged left side elevation of the transfer switch on line 2—2 of FIG. 1 with a portion of the support cut away to show the rocker.
Figure 4:
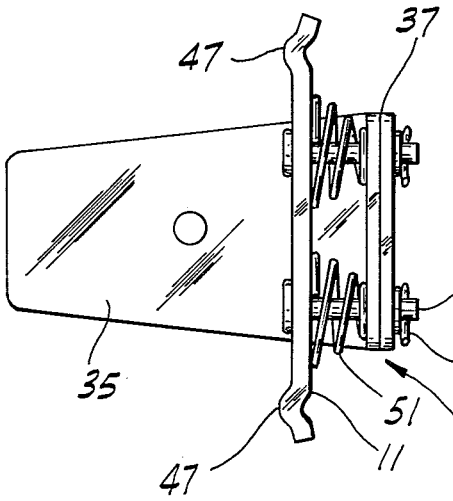
FIG. 4 is a side elevation of the rocker showing a movable contactor yieldably mounted thereon.
Figure 5:
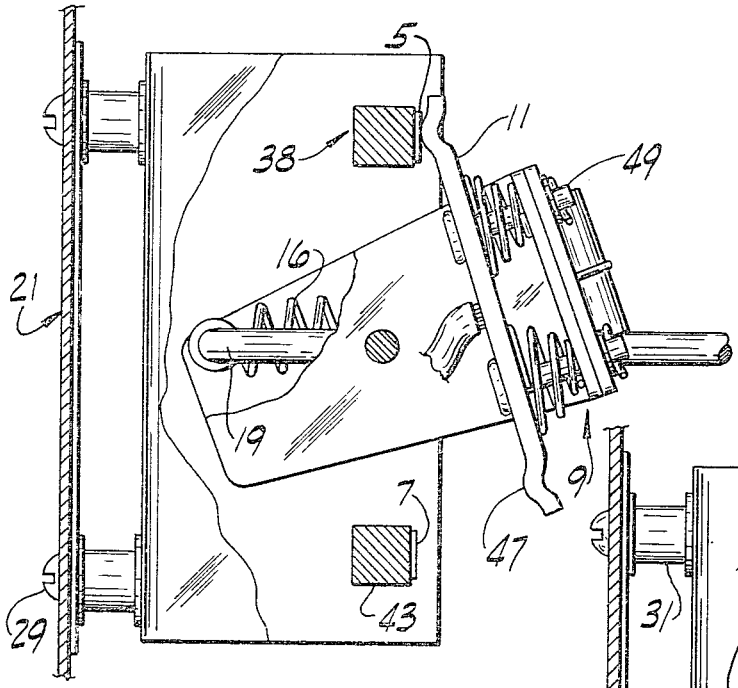
FIG. 5 is a left side elevation of the switch similar to FIG. 2 but showing the shaft in a rotated position.
Figure 6:
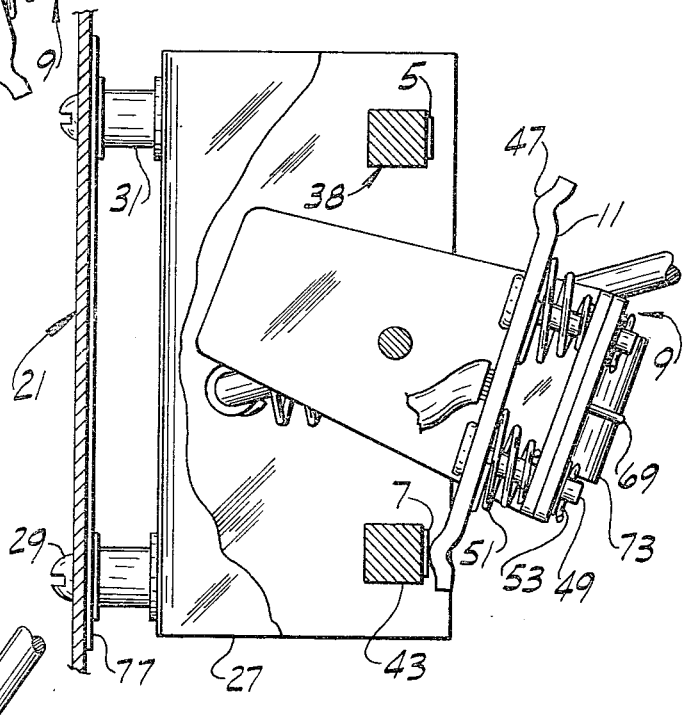
FIG. 6 is a left side elevation of the switch similar to FIG. 5 but showing the shaft in a further rotated position.
Figure 7:
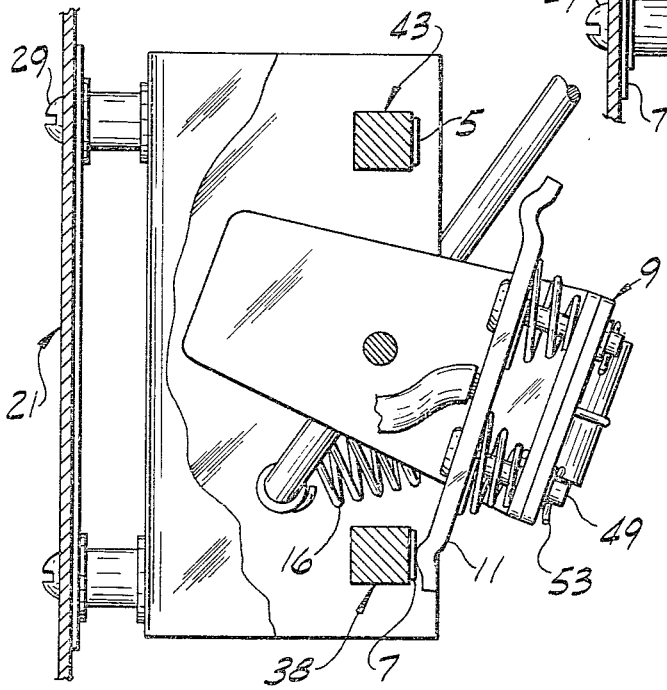
FIG. 7 is a left side elevation of the switch similar to FIG. 6 but showing the shaft in a still further rotated position.
Figure 8:
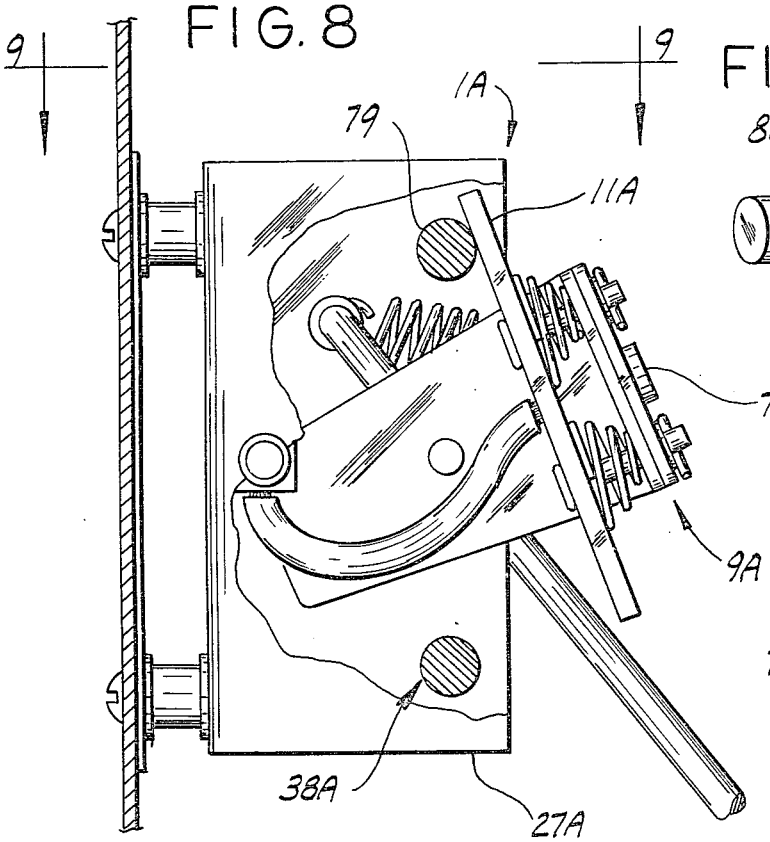
FIG. 8 is an enlarged left side elevation of an alternative embodiment of the transfer switch of this invention with a portion of the support broken away.
Figure 10:
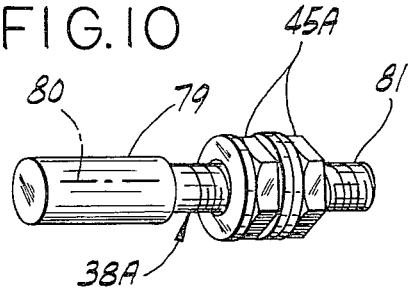
FIG. 10 is a perspective of the fixed contact means.
Figure 11:
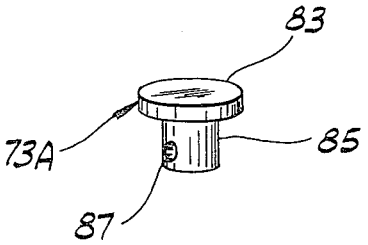
FIG. 11 is an enlarged perspective of the spring securing means.
Figure 9:
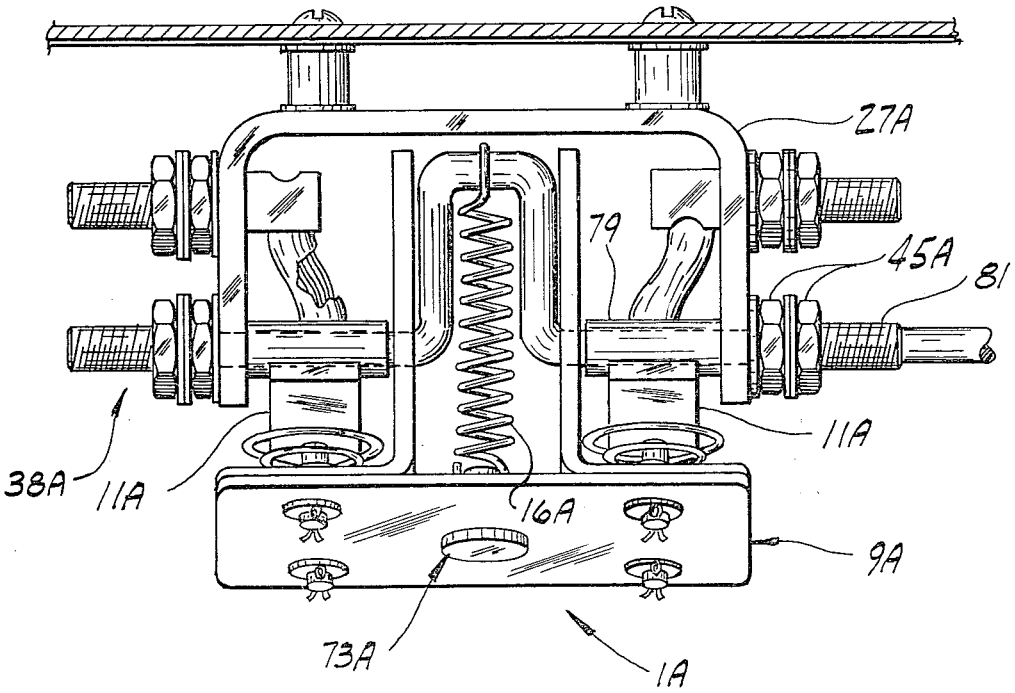
FIG. 9 is a top plan on line 9—9 of FIG. 8 showing fixed contact means and means for securing the spring.

The overcentering spring 16 has loops 69 at each end thereof, one loop being held on the crank by washers and cotter pins 71, the other loop extending through a hole in the crosshead of the rocker. Means 73 such as a locking bar is provided for releasably securing the spring to the rocker. As shown in FIG. 2, the spring 16 biases the rocker 9 to its first position for engagement of movable contactors 11 with the first fixed contacts 5 when the shaft 15 is in its first angular position. As shown in FIG. 7, the spring biases the rocker to its second position for engagement of the movable contactors with the second fixed contacts 7 when the shaft is in its second angular position. As shown in FIGS. 5 and 6, as the shaft 15 is rotated between its first and second positions, the direction of the line of action of the force developed by the spring 16 and applied to the rocker changes. When the shaft has been rotated a substantial portion of the arc of the travel of the shaft between its first and second angular positions, the line of action of the force intersects the axis about which the rocker pivots (i.e., the longitudinal axis 74 of the shaft 15), thereby placing the rocker in a highly unstable condition. The rocker (as shown in FIGS. 2 and 5) remains substantially in its first position at least until the shaft is rotated sufficiently to cause the line of action of the force developed by the spring to intersect axis 74 of the shaft. As shown in FIGS. 6 and 7 the rocker snaps to its other position upon further rotation of the shaft, as the line of action of the force moves beyond the pivot axis 74 of the rocker.

As the movable contactors 11 snap from one pair of fixed contacts to the other, the movable contactors first break the circuit between one power source and the load before making the circuit between the other power source and the load. The switching action, however, occurs quite rapidly so that, as a practical matter, there is very little interruption of the current.

The housing 21 is constructed of suitable material such as sheet metal. Preferably, it has knock-out holes (not shown) in its side walls for entry of the conductors, and mounting means 75 at its ends for mounting the housing 21 to a structure, a power pole or the like. To insure that the housing is properly insulated from the switch 1 a sheet of insulating material 77 is provided between the housing and the spacers 31 and fasteners 29 mounting the switch on the housing.

In the use of the switch 1 with the switch connected to two power sources and a load, and with the shaft 15 in its first angular position as shown in FIG. 1, the movable contactors 11 engage the first fixed contacts 5, as shown in FIG. 2, for completing a circuit including the load and one of the power sources (e.g., line power). To transfer the load to the other power source (e.g., a generator), the operator moves the handle 17 to rotate the shaft. As shown in FIGS. 5–7, when the shaft is rotated from its first to its second angular position the rocker 9 snaps from its first position to its second, the movable contactors breaking the circuit including the first fixed contacts 5 before making the circuit including the second fixed contacts 7. The movable contactors 11 may be returned to engagement with the first fixed contacts 5 for completing the circuit including line power in a manner similar to that described above by turning the handle 17 in the opposite direction.

While the switch 1 of this invention is shown and described to be a double-pole throw switch, it is contemplated that the principles of its construction and action may be incorporated into other types of switches, such as for example single pole-double throw switches and triple pole-double throw switches.

An alternative embodiment 1A of the transfer switch of this invention is shown in FIGS. 8–11. It is generally similar to the transfer switch 1 shown in FIGS. 1–7 except that the contactors 11A, the fixed contact means 38A, and the spring securing means 73A are of construction different from the corresponding elements of the transfer switch 1. In particular, each contactor 11A is relatively flat throughout its length, and thus has a generally flat contact surface at each end thereof engageable with one of the fixed contact means 38A. Each fixed contact means comprises a generally cylindrical member 79 having an extension at one end thereof constituting a terminal such as a threaded binding post 81, and means such as nuts 45A on the binding post for releasably securing the contact means to the channel 27A with the cylindric surface of the member 79 presenting along its length a line of engagement with the contact surface of the respective contactor, such as for example line 80 in FIG. 10. The binding post 81 is received in a hole in an outer corner of the channel 27A in rotary sliding engagement, the member 79 thus being adjustable by turning it about its axis to any of a plurality of different angular positions for presenting to the flat contact surface of the respective contactor a plurality of different lines of engagement, one for each angular position of the member. The member 79 may be secured to the channel in any of its angular positions by tightening the inner nut 45A on the bonding post against the side of the channel 27A. The life of the switch 1B may be extended by changing the angular position of the member 79 from time to time as a line of engagement on the contact means becomes eroded through usage. Preferably, the binding post and the member are integral and of a suitable material such as a copper alloy containing tellurium or sulphur. The spring retaining means 73A comprises a headed pin 83 having a shank 85 adapted to extend through the hole in the crosshead of the rocker 9A, a hole 87 being provided in the shank adapted to receive the upper loop of the spring 16A.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A transfer switch comprising:

a support;

first and second fixed contacts mounted on the support, the first contact being connected to a terminal adapted to be connected to line power and the second contact being connected to a terminal adapted to be connected to a generator;

a rocker pivotable between first and second positions;

a contactor carried by the rocker, connected by a flexible conductor to a terminal mounted on the support, the contactor being movable with respect to the first and second contacts and being engageable with the first contact when the rocker is in its first position and being engageable with the second contact when the rocker is in its second position, whereby said terminal on the support is adapted to be connected to line power when the rocker is in its first position and to the generator when the rocker is in its second position; and an actuator for moving the rocker between its first and second positions comprising a shaft rotatably mounted on the support and an overcentering spring, said shaft having a handle and a crank, said spring being secured at one end to the crank and at the other end to the rocker, the rocker being rotatably mounted on the shaft, the shaft being pivotable between first and second angular positions, the spring biasing the rocker to its first position when the shaft is in its first angular position and biasing the rocker to its second position when the shaft is in its second angular position, the spring applying a force to the rocker causing the rocker to snap from one of its positions to the other when the shaft is rotated from one of its angular positions to the other.

2. A transfer switch as set forth in claim 1 further comprising first and second stops, and wherein said shaft has a generally radially extending projection engageable with the first stop when the shaft is in its first angular position and with the second stop when the shaft is in its second angular position.

3. A transfer switch as set forth in claim 2 wherein said crank and said projection are spaced apart along the length of the shaft, and extend radially from the shaft in generally opposite directions, and wherein said projection constitutes said handle.

4. A transfer switch as set forth in claim 3 wherein said switch is secured within a housing, said shaft projecting out of the housing through a hole therein said stops being secured to an outer wall of the housing adjacent said hole, said handle being accessible from outside the housing.

5. A transfer switch as set forth in claim 1 wherein the rocker is pivotable about the axis of the shaft and wherein the direction of the line of action of the force developed by the spring and applied to the rocker changes as the shaft is rotated between its first and second angular positions, the rocker remaining substantially in its first position at least until the shaft is rotated sufficiently to cause the line of action of the force developed by the spring to intersect the axis of the shaft.

6. A transfer switch as set forth in claim 5 wherein the rocker snaps to its other position when the line of action of the force has been moved past the pivot axis of the rocker.

7. A transfer switch as set forth in claim 1 wherein said switch is a double pole-double throw switch and comprises a pair of said first fixed contacts, a pair of said second fixed contacts, and a pair of said movable contactors.

8. A transfer switch as set forth in claim 7 wherein said support has a pair of sides, and wherein the rocker has a pair of sides, the shaft extending across the switch through the sides of the support and the rocker.

9. A transfer switch as set forth in claim 8 wherein said pair of first fixed contacts are mounted on the sides of the support at one end of the support and extend inwardly from the sides, said pair of second fixed contacts are mounted to the sides of the support at the other end of the support and extend inwardly from the sides, and said pair of movable contactors are yieldably mounted on the rocker outwardly of the sides thereof.

10. A transfer switch as set forth in claim 9 wherein the support and the rocker each comprise fiberglass reinforced plastic, and the terminals each comprise a binding post extending outwardly from the support.

11. A transfer switch as set forth in claim 9 wherein said shaft further comprises means engageable with said support for preventing axial movement of the shaft with respect to the support, and wherein the sides of the crank extend between the sides of the rocker.

* * * * *